United States Patent [19]

Gee et al.

[11] 4,167,825

[45] Sep. 18, 1979

[54] MATERIAL DIVERTING APPARATUS FOR AN AUGER SCRAPER

[75] Inventors: James E. Gee, Washington; Edward J. Ohms, East Peoria; Craig W. Riediger, Washington, all of Ill.

[73] Assignee: Caterpillar Tractor Co., Peoria, Ill.

[21] Appl. No.: 921,373

[22] Filed: Jul. 3, 1978

[51] Int. Cl.[2] ..... E02F 3/62

[52] U.S. Cl. ..... 37/4; 198/671; 414/526

[58] Field of Search ..... 37/4, 8; 198/657, 662, 198/671, 674–677; 214/83.32

[56] References Cited

U.S. PATENT DOCUMENTS

| | | | |
|---|---|---|---|
| 3,533,173 | 10/1970 | Fenske | 37/4 |
| 3,533,174 | 10/1970 | Carston | 37/4 |
| 3,735,904 | 5/1973 | Vissers | 37/8 X |
| 3,747,697 | 7/1973 | Russell, Jr. | 37/4 X |
| 3,812,607 | 5/1974 | Fenske | 37/4 |
| 3,857,190 | 12/1974 | Gee et al. | 37/8 |
| 3,859,741 | 1/1975 | Reinhardt | 37/8 |
| 4,060,289 | 11/1977 | Gee et al. | 37/8 X |

*Primary Examiner*—E. H. Eickholt
*Attorney, Agent, or Firm*—John L. James

[57] ABSTRACT

A scraper (10) has a bowl (12) and floor (14) and is of a construction sufficient for receiving an auger (18). Material entering the bowl (12) is sometimes lodged between the auger (18) and floor (14). Apparatus (24) is provided for diverting incoming material and preventing the lodging of material between the auger (18) and floor (14).

18 Claims, 11 Drawing Figures

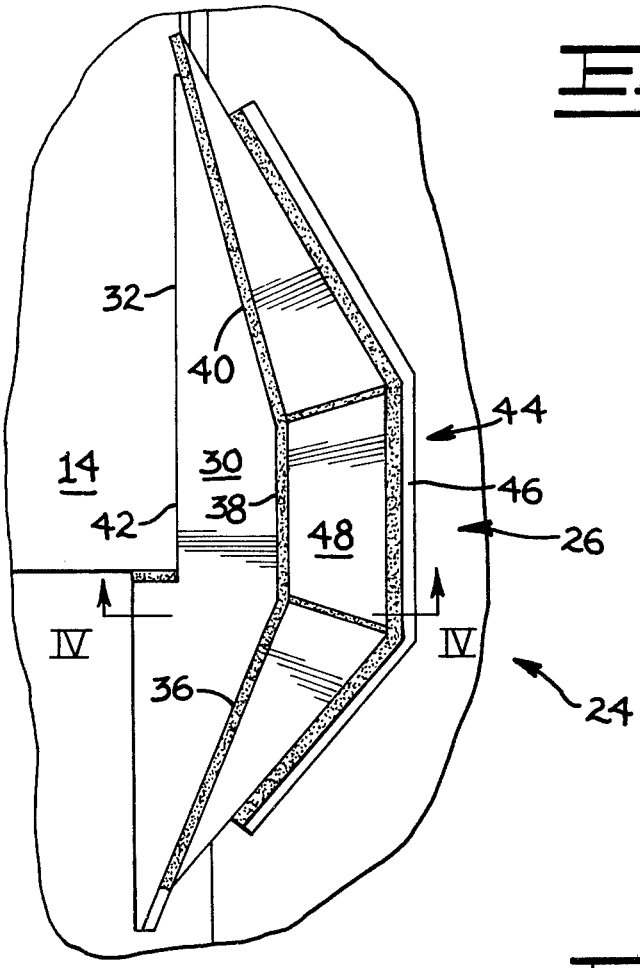
Fig. 3
Fig. 4
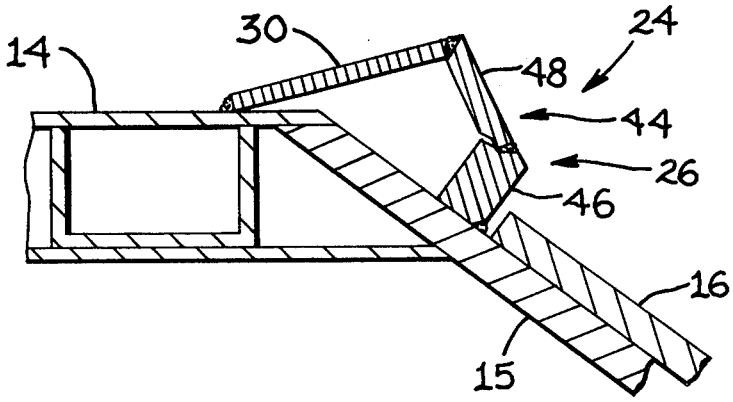

MATERIAL DIVERTING APPARATUS FOR AN AUGER SCRAPER

TECHNICAL FIELD

This invention relates to self loading scrapers, particularly self loading auger scrapers.

BACKGROUND ART

Scrapers are used to load and transport large volumes of earth or other material. A scraper typically has a cutting edge for cutting the material and a bowl for holding and transporting the cut material. To effectively utilize the load holding and transporting capacity of the bowl, an auger is provided to distribute the cut material as the cut material enters the bowl. Such auger scrapers are disclosed in U.S. Pat. No. 3,533,74 which issued on Oct. 13, 1970 to Walter Carston and in U.S. Pat. No. 3,857,190 which issued on Dec. 31, 1974 to James E. Gee and Robert N. Stedman.

In U.S. Pat. No. 3,533,174 the leading or cutting edge of the auger is spaced from the cutting edge of the scraper and from the floor or the bowl. The leading edge extends outwardly over the scraper cutting edge. During operation, oversized material and rocks sometimes become lodged in the space between the auger and bowl floor. When this happens the loading cycle must be interrupted to dislodge the material resulting in a loss of efficiency.

In U.S. Pat. No. 3,857,190 the leading edge of the auger is positioned close to the bowl floor which reduces the possibility of lodging material between the auger and floor. However, the leading edge extends outwardly over the bowl cutting edge. As the auger rotates, material is met by the leading edge and sometimes trapped between the leading edge and bowl floor. The leading edge closes in on the material and traps it which sometimes damages the leading edge. The trapped material has to be removed before the loading can continue.

The augers extend outwardly over the cutting edge to effectively load the material into the bowl in the desired manner. The augers are mounted on the bowl floor in such a manner that there is a space between the leading edge and the bowl floor. It is therefore desirable to have an auger scraper which diverts cut material away from the space which exists between the floor and auger and which prevents material from lodging between the leading edge and bowl floor without interfering with the effectiveness of the auger.

DISCLOSURE OF INVENTION

In one aspect of the invention, a scraper has a bowl, a bowl floor and a cutting edge and is of a construction sufficient for receiving an auger which has a leading edge. The cutting edge cuts material and urges the cut material toward the bowl during movement of the scraper in a preselected direction. Apparatus is provided for diverting incoming material and preventing the lodging of oversized material between the auger and bowl during rotational movement of the auger relative to the bowl.

BRIEF DESCRIPTION OF THE DRAWINGS

FIG. 3 is an enlarged front elevational view taken along line III—III of FIG. 2;

FIG. 4 is a sectional view taken along line IV—IV of FIG. 3;

BEST MODE FOR CARRYING OUT THE INVENTION

Figure 1:
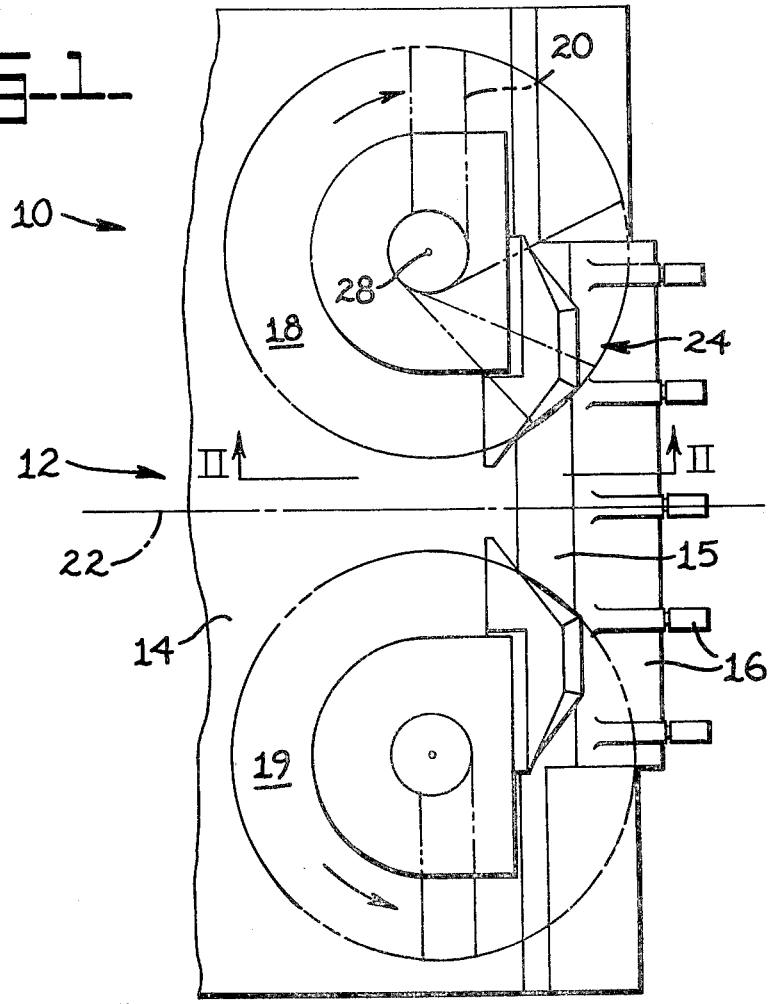
FIG. 1 is a diagrammatic top view of a portion of an auger scraper illustrating an embodiment of the present invention.

Referring to FIG. 1, an earthmoving scraper 10 has a bowl 12 with a floor 14, a cutting edge support 15 and a cutting edge 16. The scraper 10 has a construction sufficient for receiving an auger 18. The auger 18 has a leading edge 20 which urges earth or other material which has been cut by the cutting edge 16 into the bowl 12 as the auger 18 rotates relative to the bowl 12. The scraper 10 can have two augers 18,19 positioned on opposite sides of a longitudinal centerline 22 of the bowl 12. The augers 18,19 normally rotate in the direction of the arrows as shown.

Means 24 are provided for diverting incoming mterial, such as cut earth, and preventing the lodging of oversize material, such as rock, between the auger 18 and bowl floor 14 during rotational movement of the auger 18 relative to the bowl floor 14. Means 24 are provided for each of the augers 18,19 but discussion will be limited herein to the auger 18, the same discussion being applicable to the auger 19.

Referring to FIGS. 1–5, the diverting means 24 includes a bowl floor extension 26 which is connected to the bowl floor 14 superjacent the cutting edge support 15. The bowl floor extension 26 is preferably displaced along the cutting edge support 15 from the longitudinal axis 28 of the auger 18 in the direction of rotation of the auger 18. The clockwise rotation of auger 18 and counterclockwise rotation of auger 19 sweeps earth from the extensions 26 toward the center of the bowl 12.

Figure 2:
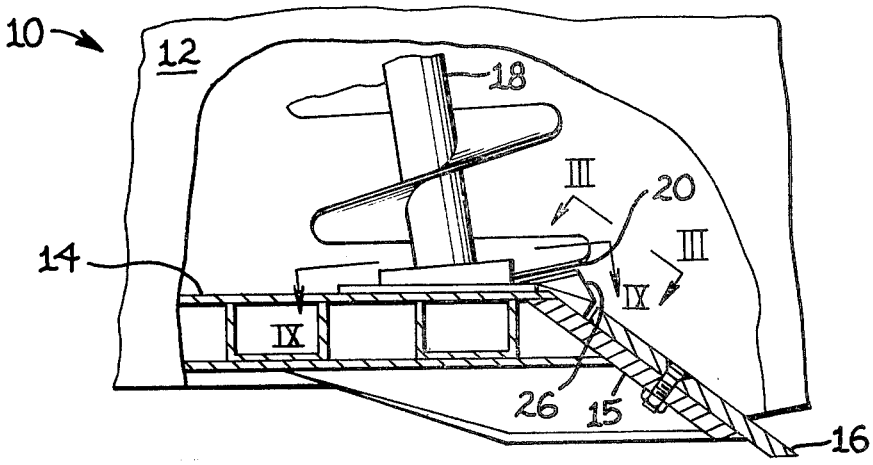
FIG. 2 is a partial sectional view taken along line II—II of FIG. 1.
Figure 6:
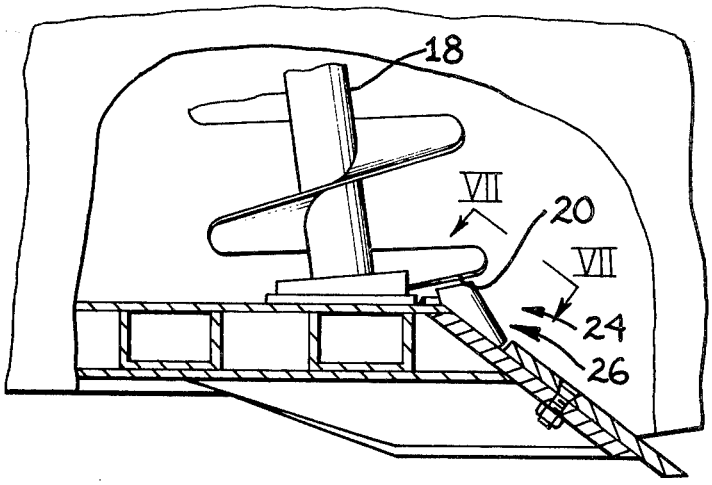
FIG. 6 is a sectional view similar to FIG. 2 but illustrating another embodiment of the present invention.

The bowl floor extension 26 extends outwardly from the bowl floor 14 under and substantially parallel to the bottom of the leading edge 20 of the auger 18 as shown in FIG. 2. The extension 26 is preferably substantially flush with the leading edge 20 as shown in FIGS. 2 and 6. A small amount of clearance is permissible between the extension 26 and leading edge 20 to allow limited vertical movement of the augers 18,19 during operation. By this construction, there is limited space between the leading edges 20 and extension 26 or cutting edge 16 making it extremely difficult for rocks or other materials to lodge therein.

Referring to FIGS. 3–4, the bowl floor extension 26 includes a top plate 30 which has a periphery 32 and is connected to the bowl floor 14 superjacent the cutting edge support 15. The periphery 32 includes first, second and third straight edges 36, 38, 40 which approximate a continuous curvilinear profile, as will be hereinafter more fully explained. A fourth edge 42 connects the first and third edges 36,40 and is adapted to fit about the auger 18.

The second edge 38 lies between the first and third edges 36, 40 and forms angles with the first and third edges 36, 40 to approximate a curve. The top plate 30 is offset from the generally vertical longitudinal axis 28 of the auger 18 along the cutting edge support 15 in the direction of rotation of the auger 18 to position the edges 36, 38, 40 at specific locations (see FIG. 1). The auger leading edge 20 forms angles with each of the first, second and third edges 36, 38, 40 during rotation of the auger 18 which are generally larger than ninety degrees as shown in broken lines in FIG. 1. By this construction, rocks and other material directly forward of the top plate 30 are prevented from becoming lodged or trapped because the angles are too large to confine the rock between the leading edge 20 and the first, second or third edges 36, 38, 40.

The top plate 30 is preferably welded to the bowl 12. The top plate 30 and bowl floor extension 26 are preferably made of strong, durable material, such as plate steel for example.

A front plate assembly 44 is connected to the top plate 30 and cutting edge support 15 and positioned adjacent the cutting edge 16 of bowl 12. The front plate assembly 44 has a construction sufficient for urging cut material deposited on the cutting edge 16 toward the top plate 30 and auger 18.

The front plate assembly 44 includes a front plate or plates 46 and a middle plate or plates 48. The bottom plates 46 are connected to one another and to the cutting edge support 15 by welding, bolting or the like. The middle plates 48 are connected to one another, the top plate 30 and bottom plate 46 by welding or the like.

The edges 36,38 and 40 of the top plate 30 are a reasonable approximation of a continuous curvilinear profile. A continuous curvilinear profile is very difficult to manufacture with plates 48, which are plate steel or other similar materials suitable for use on the scraper 10, connecting the top plate 30 to the cutting edge support 15. Where the periphery 32 is curvilinear, the angles that the leading edge 20 makes with the periphery 32 are preferably greater than ninety degrees.

Figure 8:
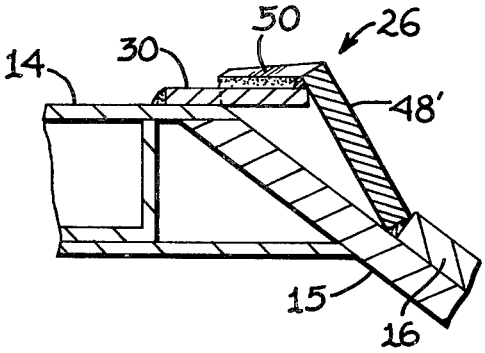
FIG. 8 is a sectional view taken along line VIII—VIII of FIG. 7.
Figure 7:
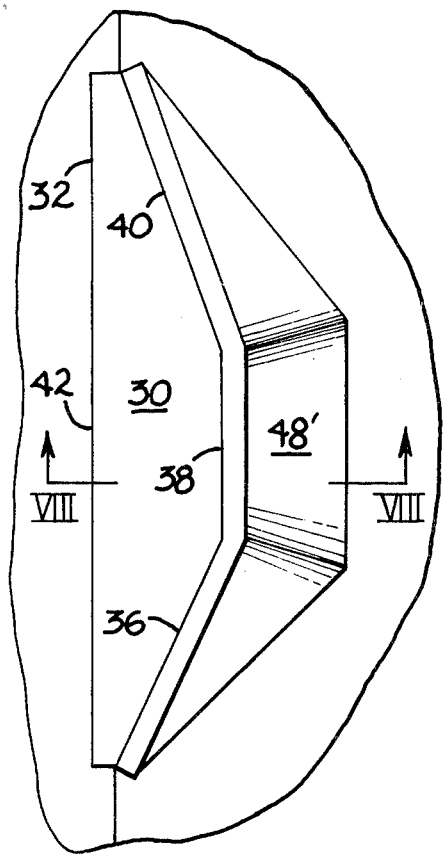
FIG. 7 is a front elevational view taken along line VII—VII of FIG. 6.

Referring to FIGS. 6–8, the bowl floor extension 26 includes the top plate 30 and a front plate 48' which is connected to the top plate 30 and cutting edge support 15. The front plate 48' is formed of one or several plates connected together and mateable with the edges 36,38 and 40 of the top plate 30. The front plate 48' can have a lip or protrusion 50 overlaying a portion of the top plate 30 and preferably connected thereto.

Figure 5:
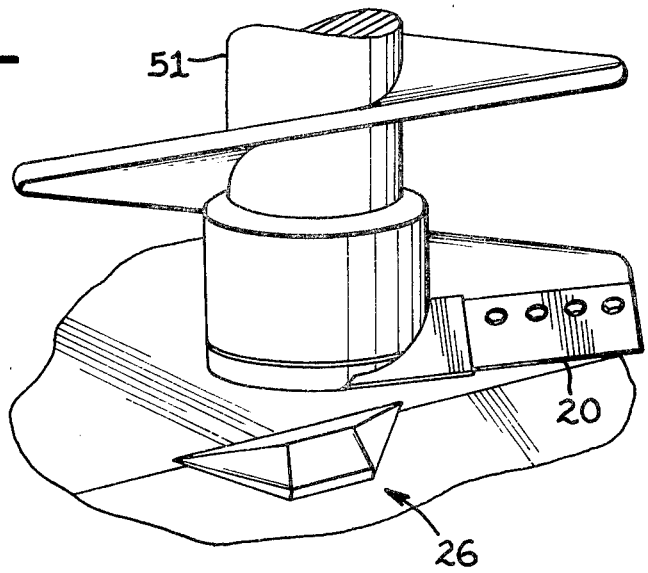
FIG. 5 is a partial isometric view of the embodiment of FIGS. 1–4.
Figure 9:
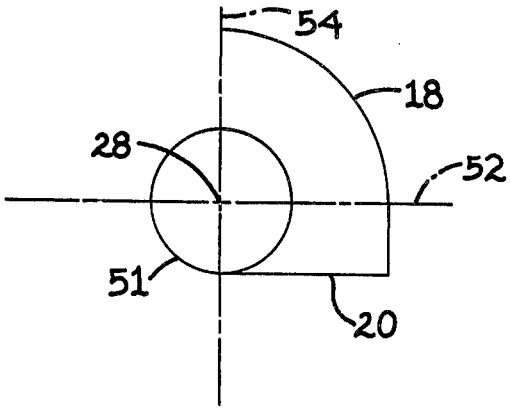
FIG. 9 is a diagrammatic partial top sectional view taken along line IX—IX of FIG. 2.

Referring to FIGS. 5 and 9, the auger 18 preferably has a shaft 51 with first and second substantially mutually perpendicular diameters or axes 52,54. The leading edge 20 of the auger 18 is generally parallel to the first axis 52 and displaced from the first axis 52 toward the second axis 54 in the direction of rotation of the auger 18. The leading edge 20 is tangent at the second axis 54 to the shaft 51 of the auger 18. The leading edge 20 is preferably connected to the auger 18 by bolts or the like and is easily replaced when worn. By this construction the leading edge 20 forms angles with the edges 36,38,40 of the top plate 30 which are generally larger than ninety degrees. The leading edge 20, as described above, and the bowl extension 26 comprise the diverting means 24.

Extending the leading edge 20 of the auger 18 so that the leading edge 20 is tangent to the shaft 51 minimizes the size of the extension 26 so that the extension 26 does not interfere with the flow of material.

Figure 11:
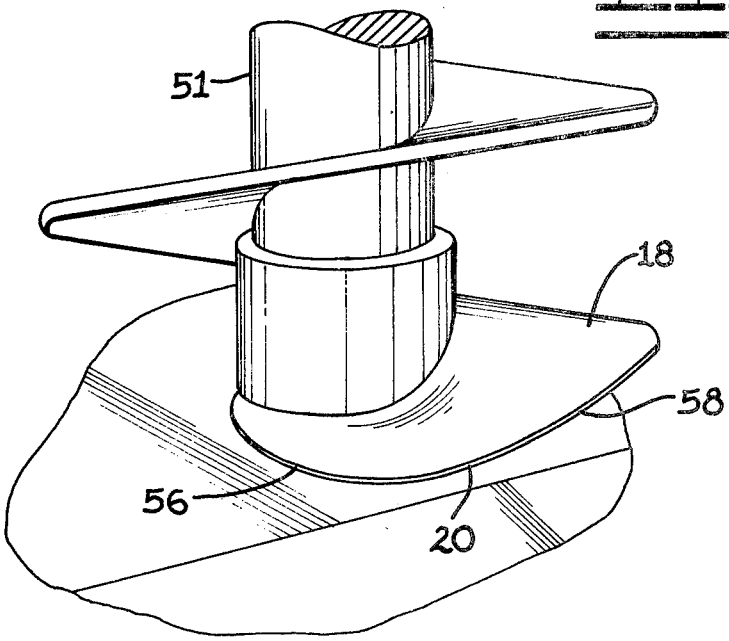
FIG. 11 is a partial isometric view of the embodiment of FIG. 10.
Figure 10:
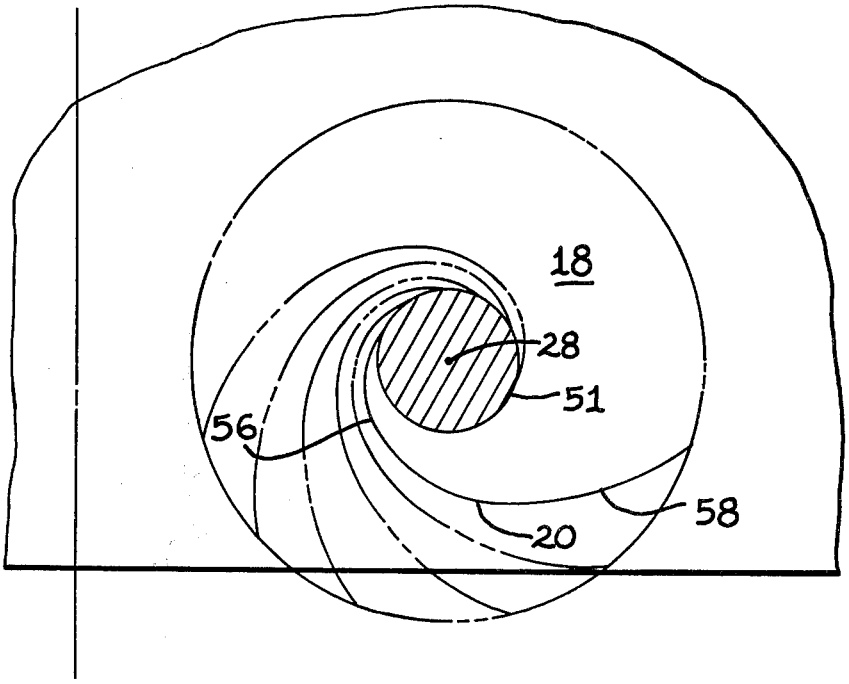
FIG. 10 is a diagrammatic top view similar to FIG. 1 but illustrating another embodiment.

Referring to FIGS. 10 and 11, leading edge 20 of the auger 18 has a configuration sufficient for forming a series of angles with the bowl 12 adjacent the cutting edge support 15 during rotation of the auger 18 which are generally greater than ninety degrees. The bowl floor extension 26 is not required in the embodiment of FIGS. 10 and 11 and the leading edge 20 can be used alone because the configuration of the leading edge 20 is sufficient to form the desired angles with the bowl 12.

Referring to FIGS. 10 and 11, the leading edge 20 of the auger 18 has a curvilinear configuration which was arrived at by experimentation. Once the configuration was known, the equation of the curvilinear configuration was determined by mathematically fitting a curve to points of the curvilinear configuration by the well known least squares method. The curvilinear configuration is generally defined by the equation $$Y=C_8X^8+C_7X^7+C_6X^6+C_5X^5+C_4X^4+C_3X^3+C_2X^2+C_1X+C_o$$

wherein X and Y are rectangular cartesian coordinates measured from the vertical axis 28 of the shaft 51 and $C_0$, $C_1$, $C_2$, $C_3$, $C_4$, $C_5$, $C_6$, $C_7$, and $C_8$ are constants. In a preferred embodiment the measured values of X and Y were as follows:

| Data Point | X | Y |
|---|---|---|
| 1 | −2 | −4 |
| 2 | −1 | −5 |
| 3 | 0 | −5.5 |
| 4 | 1 | −5.5 |
| 5 | 2 | −5.6 |
| 6 | 3 | −5.5 |
| 7 | 4 | −5 |
| 8 | 5 | −4.5 |
| 9 | 6 | −3.8 |
| 10 | 7 | −3 |
| 11 | 7.5 | −2 |
| 12 | 8 | −1 |
| 13 | 8.5 | 0 |
| 14 | 9. | 1 |
| 15 | 9 | 2 |
| 16 | 9 | 3 |
| 17 | 9.2 | 4 |
| 18 | 9.3 | 5 |
| 19 | 9.2 | 6 |
| 20 | 9 | 7 |
| 21 | 9 | 8 |
| 22 | 8.8 | 9 |
| 23 | 8.4 | 10 |
| 24 | 8 | 11 |
| 25 | 7.5 | 12 |
| 26 | 7 | 13 |
| 27 | 6.8 | 14 |
| 28 | 6 | 15 |
| 29 | 5.5 | 16 |
| 30 | 5.0 | 17 |

The leading edge 20 has a first end portion 56 adjacent the vertical axis 28 of the auger 18 and a second end portion 58 adjacent the first end portion 56 and spaced from the vertical axis 28.

A first order equation defining both the first and second portions 56,58 using all data points has a correlation coefficient of approximately 0.49 and constants approximately as follows:

$C_0=-3.5$ $C_1=1.1$

A fifth order equation has a correlation coefficient of approximately 0.63 and constants approximately as follows:

$C_0=-5.59$
$C_1=-2.94$
$C_2=0.38$
$C_3=0.56$
$C_4=-0.12$
$C_5=0.006$

An eighth order equation has a correlation coefficient of approximately 0.65 and constants as follows:

$C_0=-5.22$
$C_1=0.74$
$C_2=-0.08$
$C_3=-0.81$
$C_4=0.16$
$C_5=0.10$
$C_6=-0.04$
$C_7=0.004$
$C_8=0.0001$

A first order equation defining both the first and second portions 56,58 using only data points 1, 2, 7, 10, 12, 14, 15, 16, 20, 21, 24, 26, 28 and 30 has a correlation coefficient of approximately 0.39 and constants approximately as follows:

$C_0=-0.85$
$C_1=0.81$

A fifth order equation has a correlation coefficient of approximately 0.72 and constants approximately as follows:

$C_0=-17.73$
$C_1=-12.03$
$C_2=2.38$
$C_3=1.60$
$C_4=-0.38$
$C_5=-0.022$

A sixth order equation has a correlation coefficient of approximately 0.83 and constants approximately as follows:

$C_0=-78.73$
$C_1=-64.63$
$C_2=21.65$
$C_3=8.45$
$C_4=-3.65$
$C_5=0.44$
$C_6=-0.017$

An eight order equation has a correlation coefficient of approximately 0.83 and constants as follows:

$C_0=-76.44$
$C_1=-62.40$
$C_2=21.04$
$C_3=8.01$
$C_4=-3.52$
$C_5=0.45$
$C_6=-0.025$
$C_7=0.0009$
$C_8=-0.00003$

A first order equation defining only the first portion 56 using only data points 1, 2, 7, 10, 12, 14, 15 and 16 has a correlation coefficient of approximately 0.81 and constants approximately as follows:

$C_0=-4.54$
$C_1=0.57$

A second order equation has a correlation coefficient of approximately 0.97 and constants approximately as follows:

$C_0=-5.78$
$C_1=-6.21$
$C_2=0.16$

A fifth order equation has a correlation coefficient of approximately 0.99 and constants approximately as follows:

$C_0=-5.26$
$C_1=-0.052$
$C_2=0.14$
$C_3=-0.056$
$C_4=0.008$
$C_5=-0.0003$

A first order equation defining only the second portion 58 using only data points 20, 21, 24, 26, 28 and 30 has a correlation coefficient of approximately 0.99 and constants approximately as follows:

$C_0=29.25$
$C_1=-2.375$

A second order equation has a correlation coefficient of approximately 0.995 and constants approximately as follows:

$C_0=18.23$
$C_1=0.86$
$C_2=-0.23$

A fourth order equation has a correlation coefficient of approximately 0.997 and constants approximately as follows:

$C_0=-78.00$
$C_1=64.63$
$C_2=-15.69$
$C_3=1.63$
$C_4=-0.063$

INDUSTRIAL APPLICABILITY

In one aspect of the present invention there are left and right augers 18,19 and bowl floor extensions 26 positioned to the left and right of the centerline 22. As the scraper 10 is propelled forward, the cutting edge 16 cuts the earth. The cut material travels up the cutting edge 16 and onto the bowl extension 26. The forward motion of the cutting edge 16 and newly cut material force the original cut material past the middle plate 48 or 48' and into the leading edges 20 of the augers 18,19 which sweep it upward and into the bowl 12.

The right auger 19 rotates in a counterclockwise direction to sweep the material toward the center of the bowl 12. The left auger 18 rotates in a clockwise direction to sweep the material toward the center of the bowl 12. Cut material is free to pass between or to either side of the augers 18,19.

As the left auger 18 rotates, the leading edge 20 sweeps across the top plate 30 forming a series of angles with the first, second and third edges 36,38,40 as indicated by the broken lines. The angles are large angles, generally ninety degrees or more. Because the angles are large, rocks and other material do not lodge between the leading edge 20 and the top plate 30. Material is urged toward the centerline 22 of the bowl 12 and urged into the bowl 12 by rotation of the augers and by the forward motion of the scraper 10. Rocks and material therefore cannot lodge beneath the auger 18 because of the limited clearance beneath the leading edge 20.

In another aspect of the present invention, the leading edge 20 has a curvilinear configuration and the bowl extension 26 is smaller in size than when used with a generally straight leading edge 20. As the auger 18 rotates, the leading edge 20 forms the desired angles with the bowl extension 26 to prevent material from lodging between the auger 18 and the bowl 12.

In still another aspect of the present invention, the bowl extension 26 is not used and the leading edge 20 forms the desired angles with the bowl floor 14 at the junction of the floor 14 and cutting edge support 15. As the auger 18 rotates, the large angles prevent material from lodging between the auger 18 and the bowl 12.

Thus, the present invention diverts incoming cut material and prevents rock and other oversized material from lodging between the auger and bowl floor as the auger rotates.

Other aspects, objects and advantages can be obtained from a study of the disclosure, drawings and appended claims.

What is claimed is:

1. In a scraper (10) having a bowl (12), a bowl floor (14) and a cutting edge (16) and being of a construction sufficient for receiving an auger (18) having perpendicular first and second transverse axes (52,54) and a leading edge (20), said cutting edge (16) cutting material and urging the cut material toward the bowl (12) during movement of the scraper (10) in a preselected direction, the improvement comprising:

means (24) for diverting the incoming material and preventing the lodging of material between the auger (18) and bowl (12) during rotational movement of the auger (18) relative to the bowl (12).

2. A scraper (10), as set forth in claim 1, wherein the diverting means (24) includes a bowl floor extension (26) connected to the bowl floor (14) superjacent a cutting edge support (15).

3. A scraper (10), as set forth in claim 2, wherein the bowl floor extension (26) extends outwardly from the bowl floor (14) generally parallel to the bottom of the leading edge (20) of the auger (18).

4. A scraper (10), as set forth in claim 2, including a top plate (30) having a periphery (32) and being connected to the bowl floor (14) superjacent the cutting edge (16).

5. A scraper (10), as set forth in claim 4, wherein the periphery (32) comprises first, second and third edges (36,38,40) of the top plate (30), said second edge (40) lying between the first (36) and third (40) edges, said auger leading edge (20) forming angles with each edge (36,38,40) during rotation of the auger (18) which are generally larger than ninety degrees.

6. A scraper (10), as set forth in claim 4, further comprising a front plate assembly (44) connected to the top plate (30) and positioned adjacent the cutting edge (16) of the bowl (12) and having a construction sufficient for urging material on the cutting edge (16) toward the top plate (30) and auger (18).

7. A scraper (10), as set forth in claim 6, including a front plate (46) connected to the cutting edge support (15) and a middle plate (48) connected to the top (30) and front (46) plates.

8. A scraper (10), as set forth in claim 4, wherein the top plate (30) is displaced from the auger (18) in the direction of rotation of the auger (18).

9. A scraper (10), as set forth in claim 4, including a plurality of top plates (30) each displaced from a respective auger in the direction of rotation of said respective auger (18,19).

10. A scraper (10), as set forth in claim 1, wherein the leading edge (20) of the auger (18) is displaced from the first axis (52) toward the second axis (54) in the direction of rotation of the auger (18).

11. A scraper (10), as set forth in claim 1, wherein the leading edge (20) is tangent at one of the first and second axes (52,54) to a circle containing the first and second axes (52,54) as perpendicular diameters.

12. A scraper (10), as set forth in claim 1, wherein the diverting means (24) includes said leading edge (20) of the auger (18) having a configuration sufficient for forming a series of angles with the bowl floor (14) adjacent a cutting edge support (15) during rotation of the auger (18) which are generally greater than ninety degrees.

13. A scraper (10), as set forth in claim 12, wherein the leading edge (20) has a curvilinear configuration generally defined by the equation $$Y=C_8X+C_7X^7+C_6X^6+C_5X^5+C_4X^4+C_3X^3+C_2X^2+C_1X+C_0;$$

wherein X and Y are rectangular coordinates measured from the center of the auger (18) and wherein the constants are substantially as follows:

$C_0=-5.22$
$C_1=0.74$
$C_2=-0.08$
$C_3=-0.81$
$C_4=0.16$
$C_5=0.10$
$C_6=-0.04$
$C_7=0.004$
$C_8=-0.0001$

14. A scraper (10), as set forth in claim 12, wherein the leading edge (20) has a curvilinear configuration generally defined by the equation $$Y=C_8X^8+C_7X^7+C_6X^6+C_5X^5+C_4X^4+C_3X^3+C_2X^2+C_1X+C_0;$$

wherein X and Y are rectangular coordinates measured from the center of the auger (18) and wherein the constants are substantially as follows:

$C_0=-78.73$
$C_1=-64.63$
$C_2=21.65$
$C_3=8.45$
$C_4=-3.65$
$C_5=0.44$
$C_6=-0.017$
$C_7=0$
$C_8=0$

15. A scraper (10), as set forth in claim 12, wherein the leading edge (20) has a curvilinear configuration generally defined by the equation $$Y=C_8X^8+C_7X^7+C_6X^6+C_5X^5+C_4X^4+C_3X^3+C_2X^2+C_1X+C_0;$$

wherein X and Y are rectangular coordinates measured from the center of the auger (18) and wherein the constants are substantially as follows:

$C_0=-76.44$
$C_1=-62.40$
$C_2=21.04$
$C_3=8.01$
$C_4=-3.52$
$C_5=0.45$
$C_6=-0.025$
$C_7=0.0009$
$C_8=-0.00003$

16. A scraper (10), as set forth in claim 1, wherein the leading edge (20) of the auger (18) rotates about a vertical axis (28) of the auger (18) and wherein the leading edge (20) has a first end portion (56) adjacent the vertical axis (28) and a second end portion (58) adjacent the first end portion (56) and spaced from the vertical axis (28), said first end portion (56) being defined by the equation $$Y=C_5X^5+C_4X^4+C_3X^3+C_2X^2+C_1X+C_0$$

wherein X and Y are rectangular coordinates measured from the vertical axis (28) and wherein the constants are substantially taken from one of the groups consisting of:

| | | |
|---|---|---|
| $C_0 = -4.54$ | $C_0 = -5.78$ | $C_0 = -5.26$ |
| $C_1 = 0.57$ | $C_1 = -6.21$ | $C_1 = -0.052$ |
| $C_2 = 0$ | $C_2 = 0.16$ | $C_2 = 0.14$ |
| $C_3 = 0$ | $C_3 = 0$ | $C_3 = -0.056$ |
| $C_4 = 0$ | $C_4 = 0$ | $C_4 = 0.008$ |
| $C_5 = 0$ | $C_5 = 0$ | $C_5 = -0.0003$ |

17. A scraper (10), as set forth in claim 1, wherein the leading edge (20) of the auger (18) rotates about a vertical axis (28) of the auger (18) and wherein the leading edge (20) has a first end portion (56) adjacent the vertical axis (28) and a second end portion (58) adjacent the first end portion (56) and spaced from the vertical axis (28), said second end portion (58) being defined by the equation $$Y=C_4X^4+C_3X^3+C_2X^2+C_1X+C_0$$

wherein X and Y are rectangular coordinates measured from the vertical axis (28) and wherein the constants are substantially taken from one of the groups consisting of:

| | | |
|---|---|---|
| $C_0 = 29.25$ | $C_0 = 18.23$ | $C_0 = -78.00$ |
| $C_1 = -2.375$ | $C_1 = 0.86$ | $C_1 = 64.63$ |
| $C_2 = 0$ | $C_2 = -0.23$ | $C_2 = -15.69$ |
| $C_3 = 0$ | $C_3 = 0$ | $C_3 = 1.63$ |
| $C_4 = 0$ | $C_4 = 0$ | $C_4 = -0.063$ |

18. A scraper (10) comprising:

a bowl (12) having a floor (14);

a cutting edge (16) connected to the floor (14), said cutting edge (16) cutting material and urging the cut material toward the bowl (12) during movement of the scraper (10) in a preselected direction;

an auger (18) connected to the bowl (12); and means (24) for diverting the material and preventing the lodging of material between the auger (18) and bowl (12) during rotational movement of the auger (18) relative to the bowl (12).

* * * * *